US009013383B2

(12) United States Patent
Hough

(10) Patent No.: US 9,013,383 B2
(45) Date of Patent: Apr. 21, 2015

(54) DISPLAY SYSTEMS

(76) Inventor: David Hough, Cambridge (GB)

( * ) Notice: Subject to any disclaimer, the term of this patent is extended or adjusted under 35 U.S.C. 154(b) by 305 days.

(21) Appl. No.: 13/511,358

(22) PCT Filed: Nov. 24, 2010

(86) PCT No.: PCT/GB2010/051957

§ 371 (c)(1),
(2), (4) Date: Jul. 30, 2012

(87) PCT Pub. No.: WO2011/064578

PCT Pub. Date: Jun. 3, 2011

(65) Prior Publication Data

US 2012/0280969 A1 Nov. 8, 2012

(30) Foreign Application Priority Data

Nov. 26, 2009 (GB) ..... 0920684.8

(51) Int. Cl.
*G09G 3/36* (2006.01)
*G09G 3/34* (2006.01)

(52) U.S. Cl.
CPC ..... *G09G 3/3433* (2013.01); *G09G 2320/0219* (2013.01)

(58) Field of Classification Search
None
See application file for complete search history.

(56) References Cited

U.S. PATENT DOCUMENTS 6,229,510 B1 5/2001 Kim et al.
2005/0041004 A1 2/2005 Gates et al.
2006/0145995 A1 7/2006 Kim et al.
2006/0181492 A1 * 8/2006 Gates et al. ..... 345/84
2007/0024560 A1 2/2007 Kim et al.
2007/0052646 A1 3/2007 Ishiguchi
2007/0115274 A1 5/2007 Shih
2007/0211006 A1 9/2007 Lee et al.
2007/0229429 A1 * 10/2007 Yu et al. ..... 345/94
2008/0198122 A1 8/2008 Shin et al.
2009/0040412 A1 2/2009 Lee et al.

FOREIGN PATENT DOCUMENTS

KR 2010-0071702 6/2010
WO WO 01/47043 A1 6/2001
WO WO 01/47045 A1 6/2001

(Continued)

OTHER PUBLICATIONS

International Search Report and Written Opinion for International Application No. PCT/GB2010/051957, dated Feb. 9, 2011.
International Search Report for International Application No. GB0920684.8, dated Mar. 19, 2010.
International Search Report and Written Opinion re International Application No. PCT/GB2012/050813, dated Jul. 11, 2012.

(Continued)

*Primary Examiner* — Quan-Zhen Wang
*Assistant Examiner* — Chad Dicke
(74) *Attorney, Agent, or Firm* — Knobbe, Martens, Olson & Bear LLP

(57) ABSTRACT

We describe circuits and methods for compensating for gate kickback in electro-optic displays, in particular electrophoretic displays. In embodiments the method comprises compensating gate kickback comprising a change in voltage between a pixel electrode and a common electrode of the display arising from capacitive coupling between a gate drive line and the pixel electrode by offsetting a value of a common voltage on the common electrode by an offset value dependent on a difference between a magnitude of said positive gate voltage and a magnitude of said negative gate voltage.

11 Claims, 5 Drawing Sheets

(56) References Cited

FOREIGN PATENT DOCUMENTS

| | | | |
|---|---|---|---|
| WO | WO 2004/070466 | A1 | 8/2004 |
| WO | WO 2005/020199 | A2 | 3/2005 |
| WO | WO2005/020199 | A2 | 3/2005 |
| WO | WO 2006/056808 | A1 | 6/2006 |
| WO | WO 2006/059162 | A1 | 6/2006 |
| WO | WO 2006/061658 | A1 | 6/2006 |
| WO | WO 2006/106365 | A2 | 10/2006 |
| WO | WO 2007/029028 | A1 | 3/2007 |
| WO | WO 2009/133388 | A1 | 11/2009 |
| WO | WO 2010/066806 | A1 | 6/2010 |
| WO | WO 2011/064578 | A1 | 6/2011 |

OTHER PUBLICATIONS

Search Report issued in Application No. GB1206529.8, Aug. 13, 2012.

Combined Search and Examination Report issued in Application No. GB1206529.8, dated Aug. 14, 2012.

Combined Search and Examination Report issued in Application No. GB1312192.6, dated Jan. 23, 2014.

Examination Report issued in Application No. GB1206529.8, dated Jan. 24, 2014.

Examination Report issued in Application No. EP12717823.4, dated Oct. 22, 2014.

* cited by examiner

DISPLAY SYSTEMS

CROSS-REFERENCE TO RELATED APPLICATIONS

This application is the U.S. National Phase under 35 U.S.C. §371 of International Application No. PCT/GB2010/051957, filed Nov. 26, 2010, designating the European Patent Office and published in English on Jun. 3, 2011, as WO 2011/064578, which claims priority to United Kingdom Application No. 0920684.8, filed Nov. 26, 2009.

FIELD OF THE INVENTION

This invention relates to circuits and methods for compensating for gate kickback in electro-optic displays. The techniques are particularly advantageous in electrophoretic displays.

BACKGROUND TO THE INVENTION

In a typical active matrix display each pixel is provided with a transistor, more particularly a thin film field effect transistor (TFT, FET) which is used to control the appearance of the pixel. Broadly speaking, the gate connection of the FET is connected to a select line to select the pixel for writing data, and one of the source and drain of the FET is connected to a data line for writing data to the pixel, the other being connected to a pixel electrode for driving the display medium. In some types of display, in particular electrophoretic displays the pixel electrodes are located on one face of the display medium and a common electrode is provided covering the opposite face of the display medium thereby enabling an electric field to be provided across the display medium, for example to switch the device from one display state, say white, to another say black (or vice versa). The skilled person will appreciate that pixel circuits may in practice be more complex than this, but the same general features remain.

One problem in such displays is parasitic capacitance between the gate and pixel electrodes; in an electrophoretic display this can be exacerbated by the presence of the common pixel electrode, which is used to provide a bigger pixel capacitance. A consequence of this parasitic capacitance is that the voltage applied to a pixel electrode ends up being different to the voltage applied to the corresponding data line of the display, the actual pixel voltage being off set from that applied. This is, in effect, a side effect of the parasitic capacitances in the display when the gate connection is on, and this "kickback" has a deleterious effect on the visual appearance of the electrophoretic display.

WO 2005/020199 describes an electrooptic display with a writing mode and a non-writing mode, the display being arranged to apply a first voltage to the common electrode when the display is in its writing mode and a second voltage, different from the first voltage, when the display is in its non-writing mode. In embodiments (FIGS. 4 and 5) a sensor pixel approach is described, the purpose of these pixels being to provide an indication of the required feedthrough voltage; in another embodiment (FIG. 9) an approach is described which uses an internal adjustment which does not require the presence of sensor pixels, instead substituting a capacitor. In a still further embodiment (FIG. 10) a controller is used to control the voltage offset between the voltage applied to the common electrode when the display is in its non-writing mode ($V_{SM}$) and the voltage applied to the common electrode when the display is in its writing mode ($V_{COM}$).

By contrast with the approach described in WO'199, in which writing and non-writing display modes are invoked, the inventors have recognised that a different approach may be used, without reliance on a non-writing display operation mode.

Other known systems are described in US2007/211006, US2008/198122, US2009/040412 and WO2005/020199.

SUMMARY OF THE INVENTION

According to the present invention there is therefore provided a method of compensating for gate kickback in an electrooptic display, the display comprising an electrooptic display medium having a plurality of pixels and being mounted on a backplane, said backplane bearing a plurality of pixel driver circuits for said plurality of pixels, each said pixel driver circuit comprising a transistor having drain, source and gate connections, one of said drain and source connections being electrically coupled to a pixel electrode of a respective pixel, said gate electrode being electrically coupled to a gate drive line of said electrooptic display, said pixel driver circuit further having a common electrode, said common electrode being coupled to provide a common electrode connection for a plurality of said pixels, wherein, in use, a gate voltage on said gate drive line is controlled between a positive gate voltage with respect to a common voltage on said common pixel electrode and a negative gate voltage with respect to said common voltage on said common electrode to control information displayed by a pixel of said electrooptic display, and wherein the method comprises compensating gate kickback when driving said display, said gate kickback comprising a change in voltage across a said pixel electrode and said common electrode arising from capacitive coupling in said electrooptic display between a said gate drive line and a said pixel electrode, wherein said compensating comprises offsetting a value of said common voltage on said common electrode by an offset value dependent on a difference between a magnitude of said positive gate voltage and a magnitude of said negative gate voltage.

In general, when an electrooptic, in particular an electrophoretic display is manufactured each display has a different parasitic capacitance and, in general, there may also be variations in the positive and negative gate voltages employed and hence in the gate voltage swing. The inventors have determined that, surprisingly, the shift or offset between the voltage applied across the data and common connections of the display and the voltage actually appearing across the pixel electrode of a pixel and the common pixel electrode is a function of the change in gate voltage, more particularly of the difference between the positive and negative gate voltages employed. In embodiments the display is a monochrome display and the positive and negative gate voltages correspond to "black" and "white" pixel values, that is the positive and negative gate voltages and extremal (maximum/minimum) values between which the pixel electrode is switched. The skilled person will appreciate, however, that in principal the technique may also be applied to a colour electrooptic display.

The methods we describe are especially advantageous in the case of an electrooptic display/backplane on a flexible substrate, such as a plastic substrate, for example a thin sheet of PET (polyethylenetertphthalate) or PEN (polyethylenenaphthalate). This is because these tend to have a large parasitic capacitance and thus a relatively large fraction of the gate voltage swing is coupled to the pixel capacitor. The problems do not arise to the same degree in, say, an active matrix display fabricated on a glass substrate.

Preferably the backplane is fabricated using solution-based thin film transistors (TFTs) preferably patterned by techniques such as direct-write printing, laser ablation or photolithography. Further details can be found in the applicant's earlier patent applications, including, in particular, WO 01/47045, WO 2004/070466, WO 01/47043, WO 2006/059162, WO 2006/056808, WO 2006/061658, WO 2006/106365 (which describes a four or five layer pixel architecture) and PCT/GB2006/050265, all hereby incorporated by reference in their entirety. Thus in embodiments the TFTs comprise an organic semiconductor material, for example a solution processable conjugated polymeric or oligomeric material, and in embodiments the display, more particularly the backplane, is adapted to solution deposition, for example comprising solution-processed polymers and vacuum-deposited metals.

The offset value for a particular display varies from display to display and in embodiments of the method the display is one-time-programmed with the offset value, for example, at manufacture. This programming may be performed manually, for example by performing electrical and/or optical tests to determine an optimum value for the common electrode voltage dependent on the gate voltage swing (in a simple approach relying on observed visual quality of the display). However this can be time consuming.

In preferred implementations of the method, therefore, an electronic circuit is built into the display to automatically adjust the offset voltage value dependent on the gate voltage swing. In embodiments of this approach a digital input to a digital-to-analogue converter (DAC) is used to set a value for the common voltage and a reference voltage level input to the DAC is controlled by a differential amplifier (the gain of which may be less than unity), the differential amplifier having the positive and negative gate drive voltages for the display as to inputs. (Alternatively, the digital input may be used to set the offset value and the reference input the common voltage level).

The offset voltage value is dependent upon a difference between the magnitude of the positive gate voltage and the magnitude of the negative gate voltage, but, in embodiments, a simple difference between the positive and negative gate voltage values i.e. the gate voltage swing, may be employed to control the reference level of the DAC. In embodiments the offset to the common voltage is linearly dependent on more particularly proportional to the positive-negative gate voltage swing (where these positive and negative gate voltage values define reference voltage values typically maximum and minimum voltage values for the pixel electrodes). The constant of proportionality is a function of the display, and hence, although this approach dynamically controls the value of the common voltage, this control is used to control for manufacturing variations and, in embodiments, is not used for dynamic control during operation of the device based upon varying positive and negative gate voltage values—these are typically fixed by the design of the display. (The skilled person will appreciate that although reference is made to positive and negative gate voltage values, these are with respect to the value of the common voltage and, depending upon the ground reference, the negative gate voltage may be considered to be a zero level in which case the common voltage is between, approximately halfway between this (arbitrary) zero voltage level and the positive gate voltage).

The invention also provides an electrooptic display and/or an electronic document reading device including such a display, programmed with a common voltage offset value using a method as described above.

In a related aspect the invention provides an electrooptic display, the display comprising an electrooptic display medium having a plurality of pixels and being mounted on a backplane, said backplane bearing a plurality of pixel driver circuits for said plurality of pixels, each said pixel driver circuit comprising a transistor having drain, source and gate connections, one of said drain and source connections being electrically coupled to a pixel electrode of a respective pixel, said gate electrode being electrically coupled to a gate drive line of said electrooptic display, said pixel driver circuit further having a common electrode, said common electrode being coupled to provide a common electrode connection for a plurality of said pixels, wherein, in use, a gate voltage on said gate drive line is controlled between a positive gate voltage with respect to a common voltage on said common pixel electrode and a negative gate voltage with respect to said common voltage on said common electrode to control information displayed by a pixel of said electrooptic display, the display further comprising a gate kickback compensation circuit for compensating gate kickback when driving said display, said gate kickback comprising a change in voltage across a said pixel electrode and said common electrode arising from capacitive coupling in said electrooptic display between a said gate drive line and a said pixel electrode, wherein said compensation circuit is configured to offset a value of said common voltage on said common electrode by an offset value dependent on a difference between a magnitude of said positive gate voltage and a magnitude of said negative gate voltage.

Preferably the electrooptic display is a flexible display, for example, having a plastic substrate, in embodiments incorporating an electrophoretic display medium.

In embodiments the display includes first and second gate voltage supplies to provide the positive and negative gate voltages; these may simply be power supply lines to the display but preferably will comprise a positive and negative bias voltage generators. In embodiments the gate kickback compensation circuit comprises a differential amplifier (in embodiments with a gain of less than unity having a first input coupled to the positive gate voltage supply and a second input coupled to the negative gate voltage supply, and having an output coupled to drive the reference input to a DAC, a digital input to the DAC in combination with the reference level input determining the common voltage. Alternatively (but less preferably) the output of the differential amplifier may be used to determine a digital input to the DAC and the reference input to the DAC may be provided with a (fixed) reference value to control the common voltage level via the output of the DAC. The skilled person will appreciate that, in principal, either of the digital input and the reference level input of the DAC may be used to determine the "base" value of the common voltage, the other input to the DAC being used to control the offset to this common voltage.

The above displays and methods are particularly useful in an electronic document reading device.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1A:
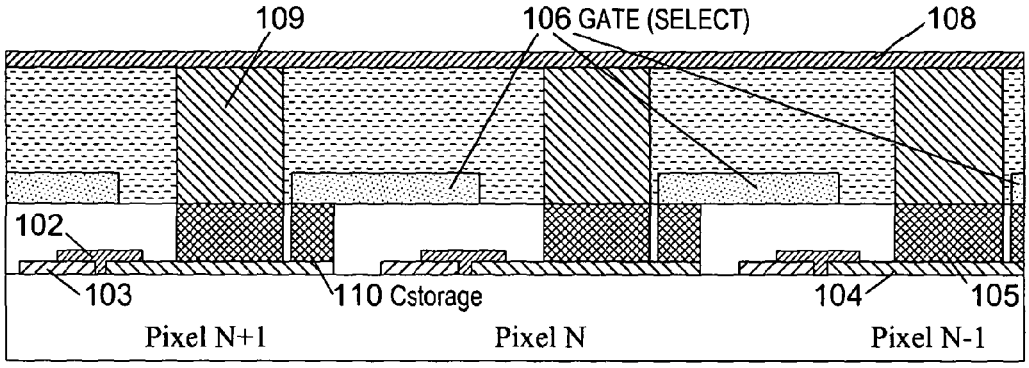
FIGS. 1*a* and 1*b* are orthogonal side views of a portion of a display showing a first example active matrix pixel driver structure including a multi-layer transistor structure and pixel capacitor.

The techniques we will describe simplify methods for manufacturing functional multilayer devices on dimensionally unstable substrates, in particular manufacturing of electronic display devices on flexible, plastic substrates.

Active matrix displays, where the pixel voltage or current is controlled by one or more thin film field effect transistors, dominate electronic display design. In, say, a top-gate transistor TFT (either a top-gate or a bottom-gate configuration may be employed) the gate electrode needs to overlap with the semiconducting channel and the overlap regions between the gate electrode and the source and drain electrodes determine the parasitic gate-source and gate-drain overlap capacitance $C_{gs}$ and $C_{gd}$, respectively. These should generally be as small as possible to improve the switching speed of the TFTs and minimize unwanted capacitive coupling effects. In an active matrix display $C_{gs}$ is particularly important as it determines the capacitive coupling between the signals running along the gate lines and the pixel electrode. When the gate voltage is switched to turn off the TFT at the end of a particular addressing (pixel charging) cycle $C_{gs}$ causes the voltage on the pixel to tend to follow the switching of the gate voltage. This so-called kickback voltage changes the pixel voltage from the intended value to which the pixel had been charged with the signal on the data line. This problem with parasitic capacitance becomes important when $C_{gs}$ is large and the problem is particularly acute with flexible substrates, such as plastic substrates because plastic substrates exhibit significant dimensional changes when subject to mechanical stress or temperature variations both of which occur during any manufacturing process.

A pixel capacitor can be used to reduce the effect of the parasitic overlap capacitance as the kickback voltage induced on the pixel electrode by the switching gate voltage is smaller the larger the capacitance of the pixel electrode is.

The display medium itself has a capacitance so that a pixel capacitor may comprise capacitance between a pixel electrode (source or drain electrode of a pixel drive TFT) and a pixel capacitor counter electrode, which may simply comprise a common electrode extending over a (front) surface of the display (the backplane being on the display rear surface). Thus in embodiments the common electrode may be a substantially transparent electrode on the viewing surface side of the display.

Additionally or alternatively a pixel capacitor can be incorporated by arranging a portion of the pixel electrode to overlap with the gate electrode of the n−1th gate interconnect line which is at ground potential when the pixel TFTs in the n-th row are being addressed. Alternatively, a separate bus line can be defined at the gate level to overlap with the pixel capacitor portion of the pixel electrode on the source-drain level. We have previously described, in WO 2006/059162, how the shape of the pixel capacitor portion of the pixel electrode can be defined such that the value of the pixel capacitor is independent of the position of the gate/bus line. Despite this, it is useful to have techniques to compensate for the effects of the kickback voltage.

In an active matrix display pixel the pixel capacitor is formed between each of the pixel electrodes and a (common) interconnect line at a fixed potential (Vcom). The interconnect line can be a separate metallic line held at a fixed potential (usually ground potential) during the addressing of the active matrix, or it can be the (N−1)th or (N+1)th neighbouring TFT gate addressing line, that is kept at a fixed potential while the Nth gate addressing line is being addressed. This configuration is preferred because it does not require a third additional set of interconnect lines running across the display, as would be the case where there is a separate bus line.

Figure 1B:
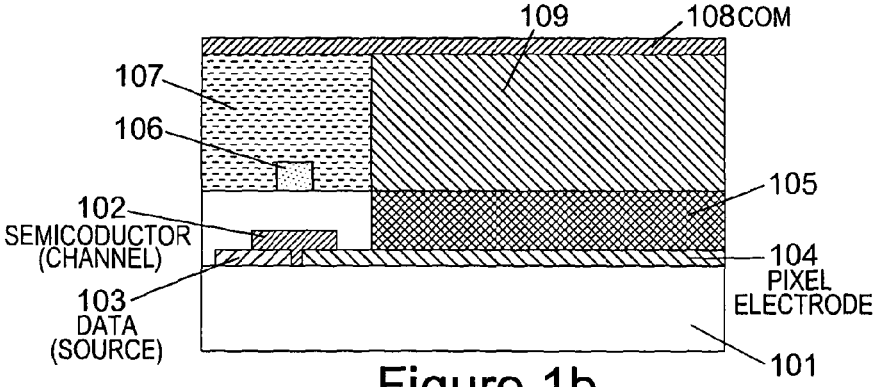
Figure 1C:
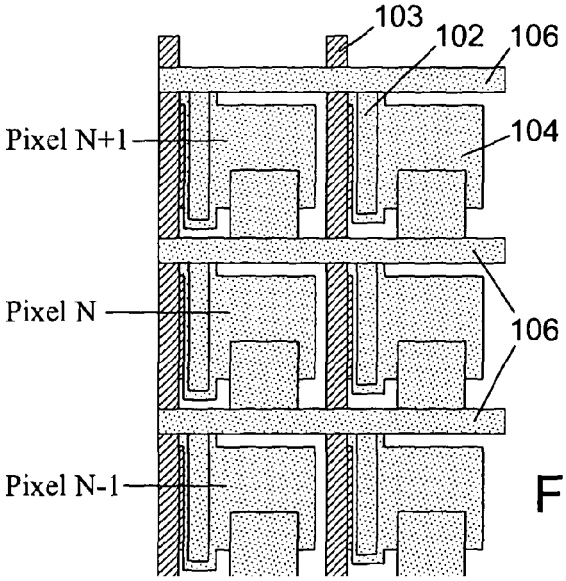
FIG. 1*c* is a top view of the arrangement of FIGS. 1*a* and 1*b;*

FIGS. 1*a* to 1*d*, which are taken from WO2004/070466, show an active matrix pixel where the display media is voltage controlled, such as liquid crystal or electronic paper. FIGS. 1*a* and 1*b* are orthogonal side views of a transistor-controlled display device including a pixel capacitor. This has a substrate 101, a semiconductor 102, which may be a continuous layer or may be patterned, (in FIG. 1, the semiconductor is patterned in order to cover the transistor channel), a data line 103, a pixel electrode 104, a transistor dielectric 105, a gate electrode/gate interconnect 106 and a display media 107 (for example liquid crystal or electronic paper) and a counter electrode 108 of the display media. In such a system the state of the display media is determined by the electric field across the media, which is a function of the voltage difference between the pixel electrode 104 and the common or counter-electrode 108 of the display medium (COM). A switchable area of the device 109 can be switched by a voltage difference between the pixel 104 and the top electrode 108. This area determines the aperture ratio of the device. FIG. 1*c* is a top view of the device and shows six transistors and six pixels arranged in three rows.

In an active matrix array, the lines are written sequentially. In order to maintain an image, the voltage written to one line should remain relatively constant during the addressing of the other lines. This is particularly true of greyscale devices. In voltage controlled devices such as liquid crystal or electronic paper, the pixel acts as a parallel plate capacitor providing a reservoir of charge. This capacitance can be augmented by the inclusion of a storage capacitor. A storage capacitor (Cstorage, enhancing the storage capacity of the pixel) can be formed by overlapping the pixel with the gate line of the neighbouring transistor. FIG. 1 shows a case where the drain electrode is the pixel electrode, and is a schematic diagram of three adjacent pixels, N=1, N and N+1 of a top gate device. The gate/gate interconnects 106 are extended to overlap part of the adjacent pixel. A capacitor 110 is formed between pixel N and the gate of pixel N−1. The resultant storage capacitor helps the pixel to maintain a constant voltage throughout the cycle. However, in this case, this overlap of the adjacent gate interconnect over the lower, drain (pixel) electrode leads to a reduction of the switchable area 109 of the device and therefore, the aperture ratio.

Figure 1D:
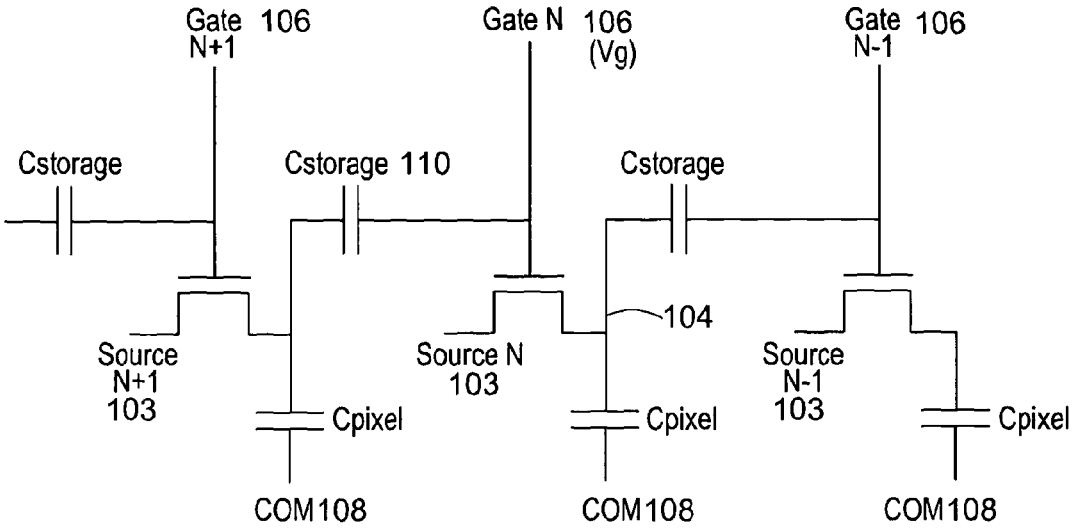
FIG. 1*d* shows the circuit diagram for the arrangement of FIGS. 1*a* to 1*c;*

FIG. 1*d* shows the circuit diagram for this arrangement, where the storage capacitor, $C_{storage}$, is formed between the pixel electrode 104 and the gate of a pixel of a neighbouring transistor. This capacitor acts as a reservoir for charge and therefore enhances the image holding ability of the pixel.

Pixel capacitors are particularly important when used in conjunction with thicker display media such as electronic paper where the thickness of the display effect, such as an electrophoretic media, leads to a lower capacitance of the display element itself. In these displays the pixel capacitor can take up a significant fraction of the pixel, especially where the kickback effect is large.

In our patent application WO2006/106365 a four or five layer architecture structure is disclosed where the pixel capacitor can be formed with one of the two electrodes of a pixel capacitor being quasi-continuous. In such a case, the pixel capacitance becomes largely insensitive to the detailed position of the other of the electrode. This can be achieved, for example, by running a straight common electrode (COM) line with a given line width smaller than the pixel pitch behind the pixel electrode. By choosing an appropriately thick dielectric between the COM line and the TFT layers a contribution to the pixel capacitance from overlap of the COM line with the drain electrode of the TFT in the first layer can be small, which leads to a uniform value of the pixel capacitance across the pixel array, important for grey scale displays.

In our patent application PCT/GB2009/050423 we have described how an off-set pixel electrode can be used to achieve increased storage capacitance: In such an off-set configuration the top pixel electrode is deposited to overlap the first capacitor plate (COM electrode) of one device and also the gate electrode of a neighbouring device.

Figure 2A:
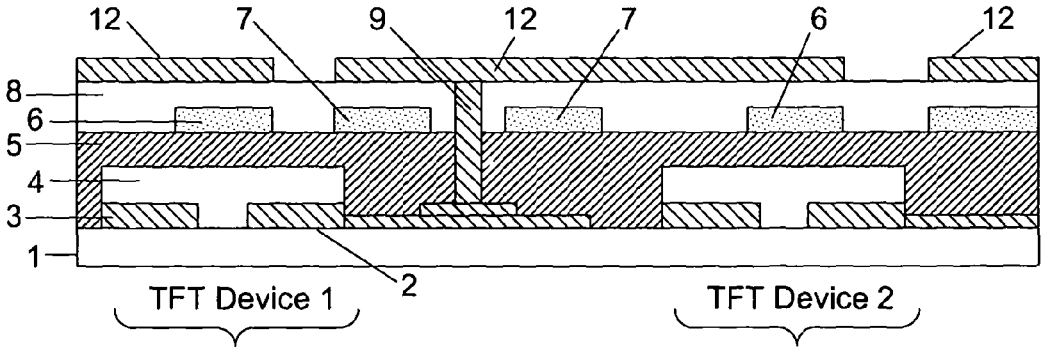
FIG. 2*a* shows a vertical cross-section (along a staggered line) through a portion of an active matrix backplane showing a second example active matrix pixel driver circuit including a multi-layer transistor structure and pixel capacitor, with an off-set the top pixel electrode configuration for reduced kick-back.
Figure 2B:
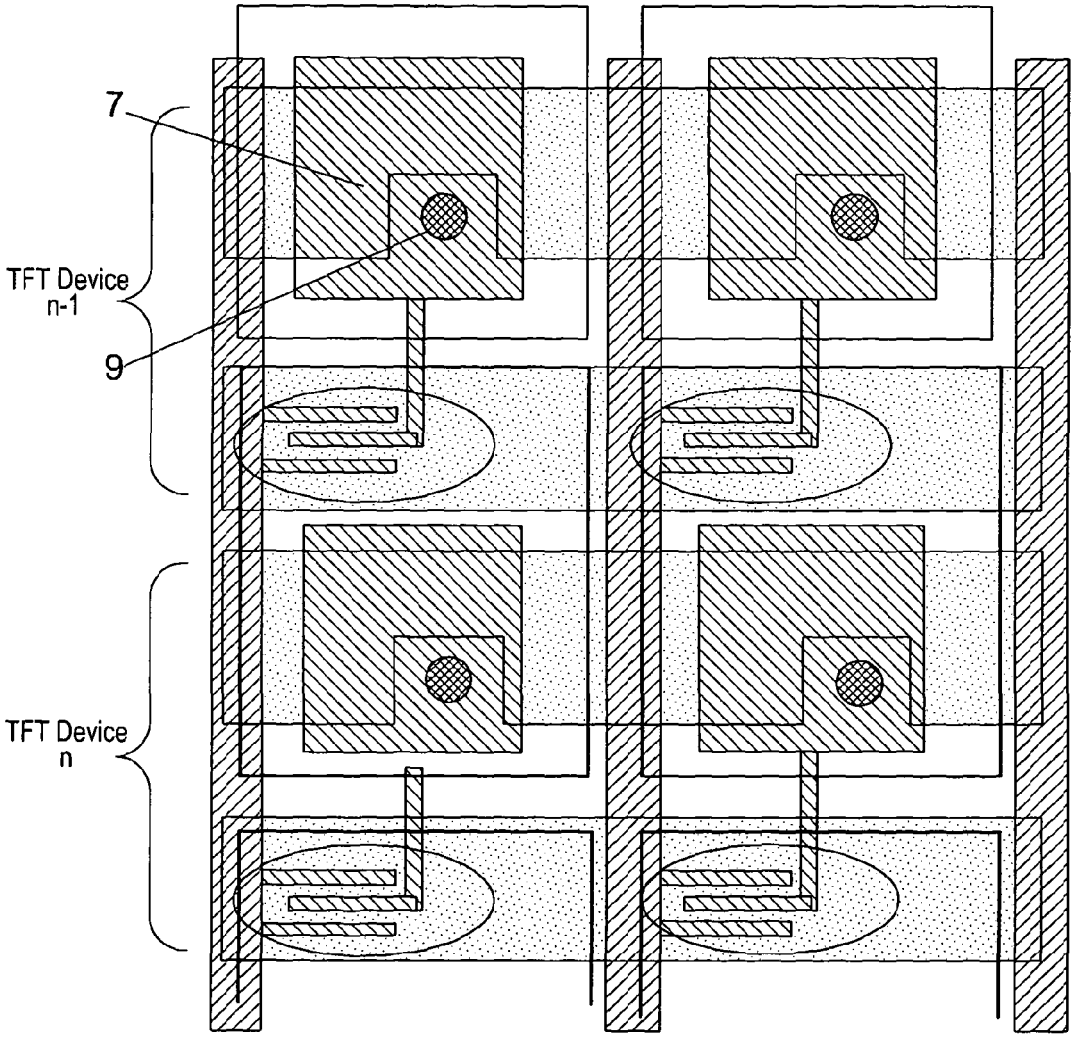
FIG. 2*b* shows the structure of FIG. 2*a* from above.

Referring to FIG. 2*a*, this shows a vertical cross-section (along a staggered line) through an example of such an active matrix backplane structure. In FIG. 2*a* a substrate 1 bears a thin film transistor (TFT) device comprising source and drain electrodes 2,3, a layer of semiconducting material 4, a gate dielectric 5 and a gate electrode/interconnect 6. A COM electrode 7 is formed in the same later as gate electrode 6. An upper dielectric 8 overlies the gate and COM electrodes and a top pixel electrode 12 is provided over dielectric layer 8, connected to one of the source/drain electrodes by a via 9. FIG. 2*b* shows the structure from above, illustrating that the COM electrode is patterned to provide a non-conducting cut-away for via 9. The top pixel electrode overlaps with the COM electrode (Cn) 7 of the first device (Device 1) and the gate electrode (Gn+1) 13 of the neighbouring device (Device 2).

Storage capacitance $C_{storage}$ is obtained from an overlap between the COM electrode and the drain electrode. The effect of an off-set top pixel electrode is an increase in overall storage capacitance caused by an overlap between the top pixel electrode and the COM electrode as well as between the top pixel electrode and the gate ($G_{n-1}$). The parasitic capacitance between the gate electrode and the drain electrode remains unchanged but the parasitic capacitance between the top pixel electrode and the gate electrode decreases and thus the storage capacitance ($C_{storage}$) may be increased by lowering the top pixel dielectric thickness. This increases the overall $C_{Storage}/C_{Parasitic}$ capacitance ratio, thus increasing overall pixel capacitance and reducing kickback voltage and variation. The top pixel dielectric layer may be tuned to maximise $C_{storage}$) without increasing $C_{parasitic}$.

Figure 3:
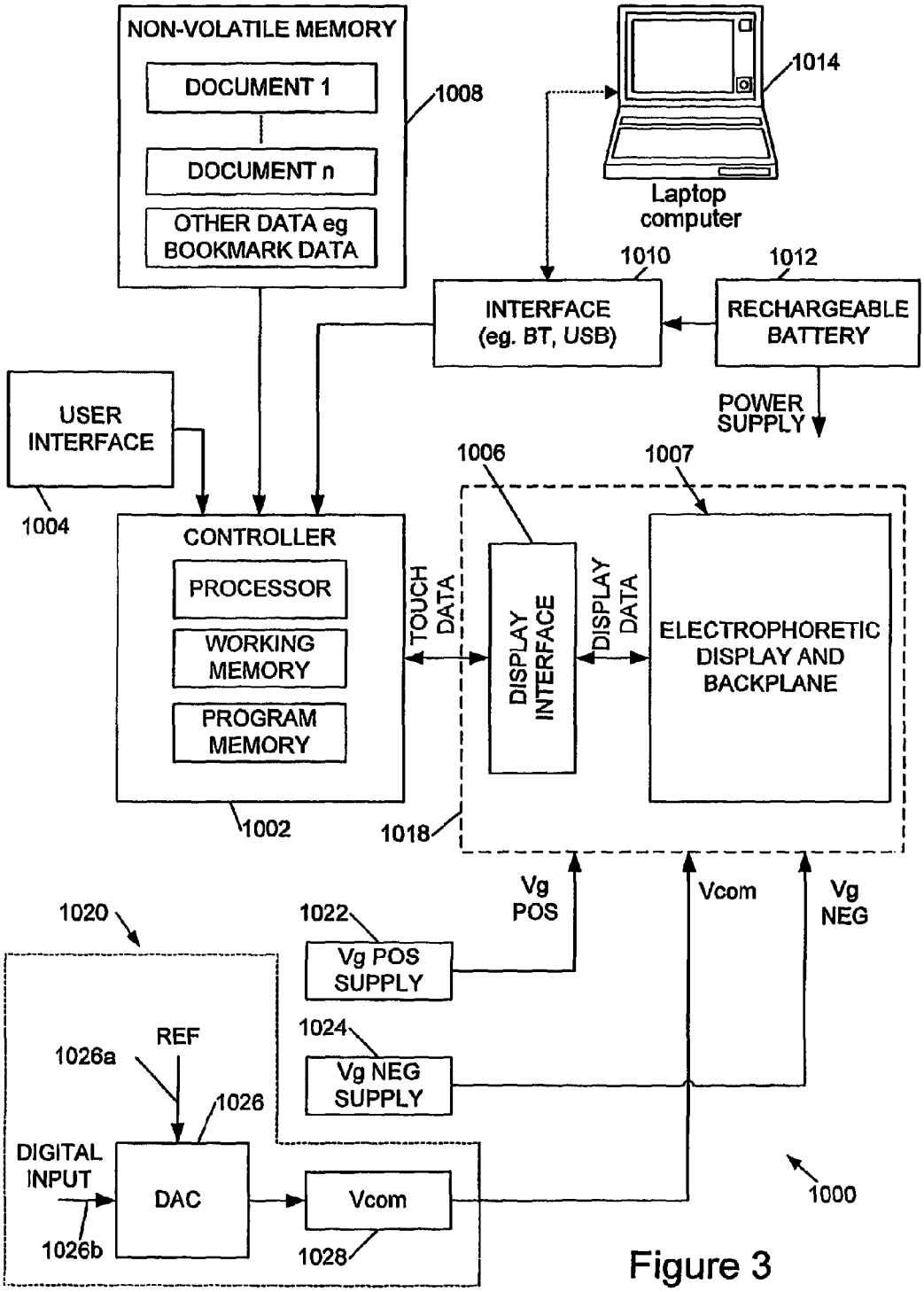
FIG. 3 shows a block diagram of an electronic document reader including a gate kickback control system.

Referring next to FIG. 3, shows a block diagram of an electronic document reader 1000 including a first example gate kickback voltage adjustment system 1020.

The electronic document reader 1000 comprises a controller 1002 including a processor, working memory and programme memory, coupled to a user interface 1004. The controller 1002 is also coupled to an active matrix backplane and electrophoretic display 1007 by a display interface 1006, to send electronic document data to the display and, optionally, to receive touch-sense data from the display (where a touch sensor is provided for the display). The control electronics also includes non-volatile memory 1008, for example Flash memory, for storing data for one or more documents for display and, optionally, other data such as user bookmark locations and the like. An external wired or wireless interface 1010, for example USB and/or Bluetooth™, is provided for interfacing with a computer such as a laptop 1014, PDA, or mobile or 'smart' phone to receive document data and, optionally, to provide data such as user bookmark data. A rechargeable battery 1012 or other rechargeable power source is connected to interface 1010 for recharging, and provides a power supply to the control electronics and display.

The power supply to the display/interface system 1018 (shown enclosed by a dashed line) includes positive and negative gate voltage supplies Vg POS, Vg NEG and a Common Voltage supply Vcom. In FIG. 3 Vg POS and Vg NEG are provided by respective gate voltage power supplies 1022, 1024. In embodiments the difference between Vg POS and Vg NEG, Vgswing, can be relatively large, for example ~70 volts. The gate kickback voltage adjustment system 1020 comprises a digital-to-analogue converter (DAC) 1026 with an output driving a buffer 1028 which in turn provides voltage Vcom to display/interface system 1018. The DAC 1026 has a digital input 1026*b*, for example from controller 1002, and a reference input 1026*a* and is configured to generate an output voltage which depends on the digital input value scaled by a signal level (voltage) on the reference input 1026*a*.

The digital input may be set by controller 1002 at an approximately correct value and then adjusted by adjusting the voltage (or current) on the reference input 1026*a*. In some embodiments this adjustment may be calculated (as described further below) or, alternatively, it may be set at manufacture (of the display or e-reader), by adjusting one or both of the digital input value and the reference level to optimise the visual appearance of the display or to minimise (or null) a measured gate kickback voltage. In embodiments the value of the digital input and/or reference determined in this way may be stored in the non-volatile memory 1008. In an example embodiment the DAC reference level was ~1 volt and the value of Vcom was ~10.5 volts.

Figure 4:
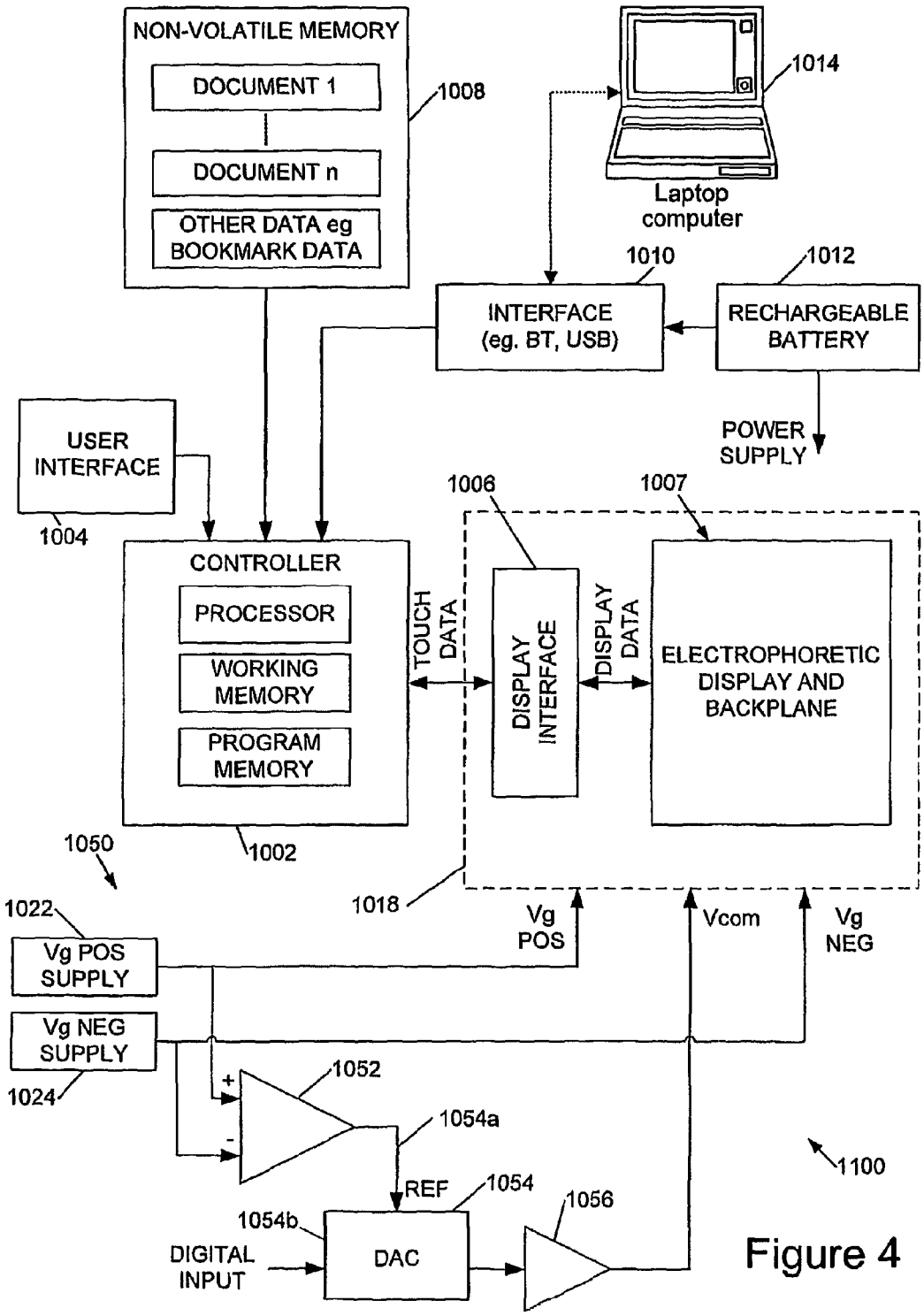
FIG. 4 shows a block diagram of an electronic document reader including an automatic gate kickback control circuit.

FIG. 4 shows a block diagram of an electronic document reader 1100 including an automatic gate kickback control circuit 1050 (like elements to those of FIG. 3 are indicated by like reference numerals).

In FIG. 4 the gate kickback control circuit 1050 is used to automatically adjust the voltage on the counterelectrode of the pixel capacitor of the display, by defining a relationship between an offset value of this common voltage and the positive and negative gate voltages. The "error" in the common voltages, in embodiments a proportion of the difference between these two voltages. Thus in embodiments the offset value of the common voltage is determined by:

$$V\text{offset}=K\times(V_g\text{POS}-V_g\text{NEG})$$

where K is a constant of proportionality. With, say, a reference level of 1 volt and a difference between positive and negative gate voltages of order 1 volt (which may occur with, say, a gate voltage swing of 70 volts), the adjustment to the reference voltage may be of order 1/70 volts. (It should be noted, however, that constant of proportionality K is a parameter of the display and is not dependent on the gate swing). In the kickback control circuit 1050 a differential or error amplifier 1052 receives inputs from the positive and negative gate voltage supplies and provides a reference level output 1054*a* to a digital-to-analogue converter 1054. The DAC 1054 has a digital input 1054*b*, for example from controller 1002, to set an approximately correct value of Vcom, and this value is then automatically adjusted by control of the reference level input to DAC 1054 (which acts as a form of multiplier) so that the value of Vcom changes slightly with the gate voltage swing.

The DAC 1054 provides a voltage output to an amplifier/driver 1056 which provides a voltage output for the Vcom connection to the display/interface system 1018. In this way the common voltage is automatically compensated for kickback arising from parasitic capacitance within the display/interface system 1018, by correcting the common voltage as a function of the difference between the on-and-off pixel states of the display. The skilled person will appreciate that this approach can be used with a range of (column) driver chips for driving an electrophoretic display (in general the positive and negative and gate bias voltages being provided as power supplies to one or more gate driver integrated circuits.

Many variations on the above described techniques are possible. For example the display could be subdivided into regions and the above described techniques applied separately to different regions of the display, for example if gate-source capacitance and/or the gate kickback effect vary across the area of a display.

No doubt many other effective alternatives will occur to the skilled person. It will be understood that the invention is not limited to the described embodiments and encompasses modifications apparent to those skilled in the art lying within the spirit and scope of the claims appended hereto.

What is claimed is:

1. A method of compensating for gate kickback in an electrooptic display, the display comprising an electrooptic display medium having a plurality of pixels and being mounted on a backplane, said backplane bearing a plurality of pixel driver circuits for said plurality of pixels, each said pixel driver circuit comprising a transistor having drain, source and gate connections, one of said drain and source connections being electrically coupled to a pixel electrode of a respective pixel, said gate electrode being electrically coupled to a gate drive line of said electrooptic display, said pixel driver circuit further having a common electrode, said common electrode being coupled to provide a common electrode connection for a plurality of said pixels, wherein, in use, a gate voltage on said gate drive line is controlled between a positive gate voltage with respect to a common voltage (Vcom) on said common pixel electrode and a negative gate voltage with respect to said common voltage (Vcom) on said common electrode to control information displayed by a pixel of said electrooptic display, the method comprising:

inputting said positive gate voltage into a differential amplifier;

inputting said negative gate voltage into the differential amplifier;

outputting a signal from the differential amplifier and providing the signal to a digital-to-analogue converter;

controlling a reference level of said digital-to-analogue converter in response to the signal from said differential amplifier; and in response to the reference level, offsetting a value of said common voltage (Vcom) on said common electrode by an offset value (Voffset), said offset value (Voffset) dependent on a gate voltage swing (Vgswing) equal to a difference between said positive gate voltage and said negative gate voltage, wherein said offset value (Voffset) is determined using Voffset=K×Vgswing, where K is a constant of proportionality for said display, and wherein said digital-to-analogue converter performs said multiplication, wherein a gate kickback voltage is minimized when driving said display, said gate kickback voltage comprising a change in voltage across a said pixel electrode and said common electrode arising from capacitive coupling in said electrooptic display between a said gate drive line and a said pixel electrode.

2. A method as claimed in claim 1 wherein said offsetting comprises determining said offset value (Voffset) for said common voltage (Vcom) and programming said electrooptic display with said offset value (Voffset).

3. An electronic document reading device or electrooptic display programmed with a said offset value according to the method of claim 2.

4. A method as claimed in claim 1 wherein said pixel driver circuit includes a pixel capacitor coupled between said pixel electrode and said common electrode, and wherein said common electrode is coupled to provide a common electrode connection for a plurality of said pixel capacitors of a plurality of said pixels.

5. A method as claimed in claim 1 wherein said display is an electrophoretic display, and wherein said electrooptic display medium is an electrophoretic display medium.

6. A method as claimed in claim 1 wherein said electrooptic display and backplane are supported on a flexible plastic substrate.

7. An electrooptic display comprising:

an electrooptic display medium having a plurality of pixels and being mounted on a backplane, said backplane bearing a plurality of pixel driver circuits for said plurality of pixels, each said pixel driver circuit comprising a transistor having drain, source and gate connections, one of said drain and source connections being electrically coupled to a pixel electrode of a respective pixel, said gate electrode being electrically coupled to a gate drive line of said electrooptic display, said pixel driver circuit further having a common electrode, said common electrode being coupled to provide a common electrode connection for a plurality of said pixels, wherein, in use, a gate voltage on said gate drive line is controlled between a positive gate voltage with respect to a common voltage (Vcom) on said common pixel electrode and a negative gate voltage with respect to said common voltage (Vcom) on said common electrode to control information displayed by a pixel of said electrooptic display, wherein the display further comprises a first gate voltage supply to provide said positive gate voltage, and a second gate voltage supply to provide said negative gate voltage, the display further comprising a gate kickback compensation circuit for compensating gate kickback voltage when driving said display, said gate kickback voltage comprising a change in voltage across a said pixel electrode and said common electrode arising from capacitive coupling in said electrooptic display between a said gate drive line and a said pixel electrode, wherein said compensation circuit is configured to offset a value of said common voltage (Vcom) on said common electrode by an offset value (Voffset) dependent on a gate voltage swing (Vgswing) equal to a difference between said positive gate voltage and said negative gate voltage to minimize said gate kickback voltage, wherein said offset value (Voffset) is determined using Voffset=K×Vgswing, where K is a constant of proportionality for said display, wherein said gate kickback compensation circuit comprises a differential amplifier, wherein said differential amplifier has a pair of inputs, a first said input coupled to said positive gate voltage supply and a second said input coupled to said negative gate voltage supply, and wherein said differential amplifier has an output, wherein said gate kickback compensation circuit further comprises a digital-to-analogue converter having a converter output coupled to said common electrode and having a digital input to set said value of said common voltage (Vcom) on said common electrode, wherein said digital-to-analogue converter is configured to perform said multiplication to calculate said offset value (Voffset) and to control said offset value (Voffset) of said common voltage (Vcom) dependent on said gate voltage swing (Vgswing), and wherein said digital-to-analogue converter has a reference level input coupled to said output of said differential amplifier to control said offset value (Voffset) of said common voltage (Vcom).

8. An electrooptic display as claimed in claim 7 wherein said display is an electrophoretic display, and wherein said electrooptic display medium is an electrophoretic display medium.

9. An electrooptic display as claimed in claim 7 wherein said electrooptic display and backplane are supported on a flexible plastic substrate.

10. An electronic document reading device incorporating the electrooptic display of claim 7.

11. An electrooptic display comprising:

an electrooptic display medium having a plurality of pixels and being mounted on a backplane, said backplane bearing a plurality of pixel driver circuits for said plurality of pixels, each said pixel driver circuit comprising a transistor having drain, source and gate connections, one of said drain and source connections being electrically coupled to a pixel electrode of a respective pixel, said gate electrode being electrically coupled to a gate drive line of said electrooptic display, said pixel driver circuit further having a common electrode, said common electrode being coupled to provide a common electrode connection for a plurality of said pixels, wherein, in use, a gate voltage on said gate drive line is controlled between a positive gate voltage with respect to a common voltage (Vcom) on said common pixel electrode and a negative gate voltage with respect to said common voltage (Vcom) on said common electrode to control information displayed by a pixel of said electrooptic display, wherein the display further comprises a first gate voltage supply to provide said positive gate voltage, and second gate voltage supply to provide said negative gate voltage, the display further comprising a gate kickback compensation circuit for compensating gate kickback voltage when driving said display, said gate kickback voltage comprising a change in voltage across a said pixel electrode and said common electrode arising from capacitive coupling in said electrooptic display between a said gate drive line and a said pixel electrode, wherein said compensation circuit is configured to offset a value of said common voltage (Vcom) on said common electrode by an offset value (Voffset) dependent on a gate voltage swing (Vgswing) equal to a difference between said positive gate voltage and said negative gate voltage to minimize said gate kickback voltage, wherein said offset value (Voffset) is determined using Voffset=K×Vgswing, where K is a constant of proportionality for said display, wherein said gate kickback compensation circuit comprises a differential amplifier, wherein said differential amplifier has a pair of inputs, a first said input coupled to said positive gate voltage supply and a second said input coupled to said negative gate voltage supply, and wherein said differential amplifier has an output, wherein said gate kickback compensation circuit further comprises a digital-to-analogue converter having a converter output coupled to said common electrode and having a digital input coupled to said output of said differential amplifier to receive a digital value to set said offset value (Voffset) of said common voltage (Vcom), and wherein said digital-to-analogue converter has a reference level input coupled to receive a signal to set said value of said common voltage (Vcom) on said common electrode, and wherein said digital-to-analogue converter is configured to perform said multiplication to calculate said offset value (Voffset).

* * * * *

UNITED STATES PATENT AND TRADEMARK OFFICE

CERTIFICATE OF CORRECTION

PATENT NO. : 9,013,383 B2
APPLICATION NO. : 13/511358
DATED : April 21, 2015
INVENTOR(S) : David Hough It is certified that error appears in the above-identified patent and that said Letters Patent is hereby corrected as shown below:

Title Page 1, First Column, Line 3, insert Item 73 -- Assignee: Plastic Logic Limited, Cambridge (GB) --

Signed and Sealed this
Fifth Day of July, 2016

Michelle K. Lee

Michelle K. Lee
*Director of the United States Patent and Trademark Office*